US007884765B2

(12) United States Patent
Liu et al.

(10) Patent No.: US 7,884,765 B2
(45) Date of Patent: Feb. 8, 2011

(54) ARRAY ANTENNA AND ELECTRONIC APPARATUS USING THE SAME

(75) Inventors: Ming-Yen Liu, Taipei (TW); Ten-Long Dan, Taipei (TW); Hsiao-Ming Tsai, Taipei (TW); Shih-Chieh Chen, Taipei (TW); Tzu-Ching Huang, Taipei (TW)

(73) Assignee: ASUSTek Computer Inc., Taipei (TW)

( * ) Notice: Subject to any disclaimer, the term of this patent is extended or adjusted under 35 U.S.C. 154(b) by 307 days.

(21) Appl. No.: 12/238,450

(22) Filed: Sep. 26, 2008

(65) Prior Publication Data

US 2009/0174613 A1 Jul. 9, 2009

(30) Foreign Application Priority Data

Jan. 4, 2008 (TW) ..... 97100334 A

(51) Int. Cl.
*H01Q 1/38* (2006.01)

(52) U.S. Cl. ..... 343/700 MS; 343/853

(58) Field of Classification Search ..... 343/700 MS, 343/702, 850, 853, 852
See application file for complete search history.

(56) References Cited

U.S. PATENT DOCUMENTS

| | | | | | |
|---|---|---|---|---|---|
| 4,899,163 | A * | 2/1990 | Daniel et al. | ..... | 343/700 MS |
| 5,258,727 | A * | 11/1993 | DuPuis et al. | ..... | 333/26 |
| 5,422,649 | A * | 6/1995 | Huang | ..... | 343/700 MS |
| 5,712,644 | A * | 1/1998 | Kolak | ..... | 343/700 MS |
| 2010/0171666 | A1 * | 7/2010 | Mizutani et al. | ..... | 343/700 MS |

* cited by examiner

*Primary Examiner*—HoangAnh T Le
(74) *Attorney, Agent, or Firm*—Jianq Chyun IP Office

(57) ABSTRACT

An array antenna and an electronic apparatus using the array antenna are provided. The array antenna includes a plurality of antenna units, a first connection line, and a second connection line. Each of the antenna units includes a rectangular radiation region, a first feeding line and a second feeding line. The first and second feeding lines are connected to two adjacent feeding corners of the rectangular radiation region. The first connection line and the second connection line are disposed at two sides of the antenna unit for connection with the other ends of the first feeding line and the second feeding line, respectively.

20 Claims, 13 Drawing Sheets

ARRAY ANTENNA AND ELECTRONIC APPARATUS USING THE SAME

CROSS-REFERENCE TO RELATED APPLICATION

This application claims the priority benefit of Taiwan application serial no. 97100334, filed on Jan. 4, 2008. The entirety of the above-mentioned patent application is hereby incorporated by reference herein and made a part of this specification.

BACKGROUND OF THE INVENTION

1. Field of the Invention

The present invention generally relates to an array antenna, and more particularly, to an array antenna capable of receiving dual polarization or circular polarization signals and an electronic apparatus using the array antenna.

2. Description of Related Art

With continuous advancing of electronic technology and fabrication technology, information products with personality and multifunction are being replaced with new ones all along. Accompany with the speedy rhythm of life nowadays, timely communication is needed more than ever. Accordingly, traditional telephones are being replaced with mobile phones, which have been considered the most convenient and quickest communication tools because of their portability and convenience. In addition, with rapid development of wireless communication technology, electronic products with wireless internet connection function are being more and more popularized, which include, for example, notebook computers, personal digital assistants (PDAs), or the like.

Whether it is for wireless communication or for wireless internet connection, an antenna design can affect the communication quality and transmission rate. For example, for a mobile phone, a base station antenna typically provides a vertical polarization or a dual polarization. After signals are transmitted from the base station, the signal polarization may be changed or rotated due to the existence of a barrier, thus degrading a signal receiving performance at a receiving end.

If the base station antenna is dual-polarized but the antenna of an electronic apparatus is mono-polarized, a polarization loss occurs at the base station in receiving signals transmitted from the electronic apparatus.

SUMMARY OF THE INVENTION

Accordingly, the present invention is directed to an array antenna and an electronic apparatus using the array antenna. A plurality of antenna units are integrated together by adopting symmetrical feeding, which not only can reduce the area needed for disposing of the antenna, but also can receive and transmit signals through a plurality of feeding points and with different polarizations, thereby increasing easiness of integration of the array antenna with a circuit as well as the signal receiving and transmitting performance.

The present invention provides an array antenna including a substrate, a plurality of antenna units, a first connection line, a second connection line, and at least one reflective plate. The antenna units are arranged in series. Each of the antenna units includes a rectangular radiation region, a first feeding line and a second feeding line. One end of each of the first and second feeding lines is connected to a respective one of adjacent first and second feeding corners of the rectangular radiation region. The first connection line is disposed on the substrate and arranged at a side of the rectangular radiation regions for connection with the other ends of the first feeding lines of the antenna units. The second connection line is disposed on the substrate and arranged at another side of the rectangular radiation regions for connection with the other ends of the second feeding lines of the antenna units. The reflective plate is disposed on the substrate and spaced apart from each of the rectangular radiation regions by a distance.

According to one embodiment of the present invention, the angle between the first feeding line and the first side of the rectangular radiation region is 135 degrees, and the angle between the second feeding line and the second side of the rectangular radiation region is 135 degrees.

According to one embodiment of the present invention, the antenna units are arranged linearly.

According to one embodiment of the present invention, the antenna units are equidistantly spaced.

According to one embodiment of the present invention, the rectangular radiation region is spaced apart from the substrate by a suspension height.

According to one embodiment of the present invention, the rectangular radiation region is disposed on a first surface of the substrate, and the reflective plate is disposed on a second surface of the substrate.

According to one embodiment of the present invention, the array antenna further includes a plurality of couplers disposed above the antenna units, respectively.

According to one embodiment of the present invention, the array antenna further includes a third feeding line and a fourth feeding line, and one end of each of the third and fourth feeding lines is connected to a respective one of adjacent third and fourth feeding corners of the rectangular radiation region.

According to one embodiment of the present invention, the antenna unit further includes a third connection line and a fourth connection line. The third connection line and the first connection line are located in different layers of the substrate. The third connection line is connected to the other ends of the third feeding lines of the antenna units. The fourth connection line and the second connection line are located in different layers of the substrate. The fourth connection line is connected to the other ends of the fourth feeding lines of the antenna units.

According to one embodiment of the present invention, the antenna units are arranged in a ring.

According to one embodiment of the present invention, the first connection line and the second connection line are equal in length.

The present invention also provides an electronic apparatus including a substrate, a plurality of first antenna units, a first connection line, a second connection line, a reflective plate, and a circuit unit. The first antenna units are arranged on a first surface of the substrate. Each of the first antenna units includes a first rectangular radiation region, a first feeding line and a second feeding line. The first and second feeding lines are connected to adjacent first and second feeding corners of the first rectangular radiation region, respectively. The first connection line is disposed on the substrate and arranged at a side of the rectangular radiation regions for connection with the other ends of the first feeding lines of the first antenna units. The second connection line is disposed on the substrate and arranged at another side of the rectangular radiation regions for connection with the other ends of the second feeding lines of the first antenna units. The reflective plate is disposed on the substrate and spaced apart from each of the rectangular radiation regions by a distance. The circuit unit is disposed on the first surface of the substrate and connected to the first antenna units through the first connection line and the second connection line.

According to one embodiment of the present invention, the electronic apparatus further includes a plurality of second antenna units disposed on a second surface of the substrate. Each of the second antenna units includes a second rectangular radiation region, a third feeding line and a fourth feeding line. One end of each of the third and fourth connection lines is connected to a respective one of adjacent third and fourth feeding corners of the second radiation region.

According to one embodiment of the present invention, the first connection line is connected to the other ends of the third feeding lines of the second antenna units, and the second connection line is connected to the other ends of the fourth feeding lines of the second antenna units.

According to one embodiment of the present invention, the electronic apparatus further includes a third connection line and a fourth connection line. The third connection line is configured to be connected to the other ends of the third feeding lines of the second antenna units. The fourth connection line is configured to be connected to the other ends of the fourth feeding lines of the second antenna units. The third connection line and the fourth connection line are located on the second surface of the substrate. The circuit unit is connected to the second antenna units through the third connection line and the fourth connection line.

According to one embodiment of the present invention, the electronic apparatus further includes a plurality of couplers disposed above the first antenna units and second antenna units, respectively.

According to one embodiment of the present invention, an angle between the first feeding line and a first side of the first rectangular radiation region is 135 degrees, and an angle between the second feeding line and a second side of the first rectangular radiation region is 135 degrees.

According to one embodiment of the present invention, each of the first antenna units further includes a third feeding line and a fourth feeding line. One end of each of the third and fourth feeding lines is connected to a respective one of adjacent third and fourth feeding corners of the first rectangular radiation region. A third connection line is configured to be connected to the other ends of the third connection lines of the first antenna units. A fourth connection line is configured to be connected to the other ends of the fourth connection lines of the first antenna units.

According to one embodiment of the present invention, the first antenna units are arranged linearly or in a ring.

According to one embodiment of the present invention, the first connection line and the second connection are equal in length.

By adopting the symmetrical feeding and rectangular radiation regions, the antenna can receive and transmit signals through different feeding points and with different polarizations such as linear polarization and circular polarization. The back-end circuit can be connected to the antenna in different directions and can selectively switch the polarizations to optimize the signal receiving and transmitting performance. Thus, the signal receiving and transmitting performance of the antenna and the easiness of integration of the antenna with the circuit can be increased.

In order to make the aforementioned and other features and advantages of the present invention more comprehensible, embodiments accompanied with figures are described in detail below.

DESCRIPTION OF THE EMBODIMENTS

First Embodiment

Figure 1:
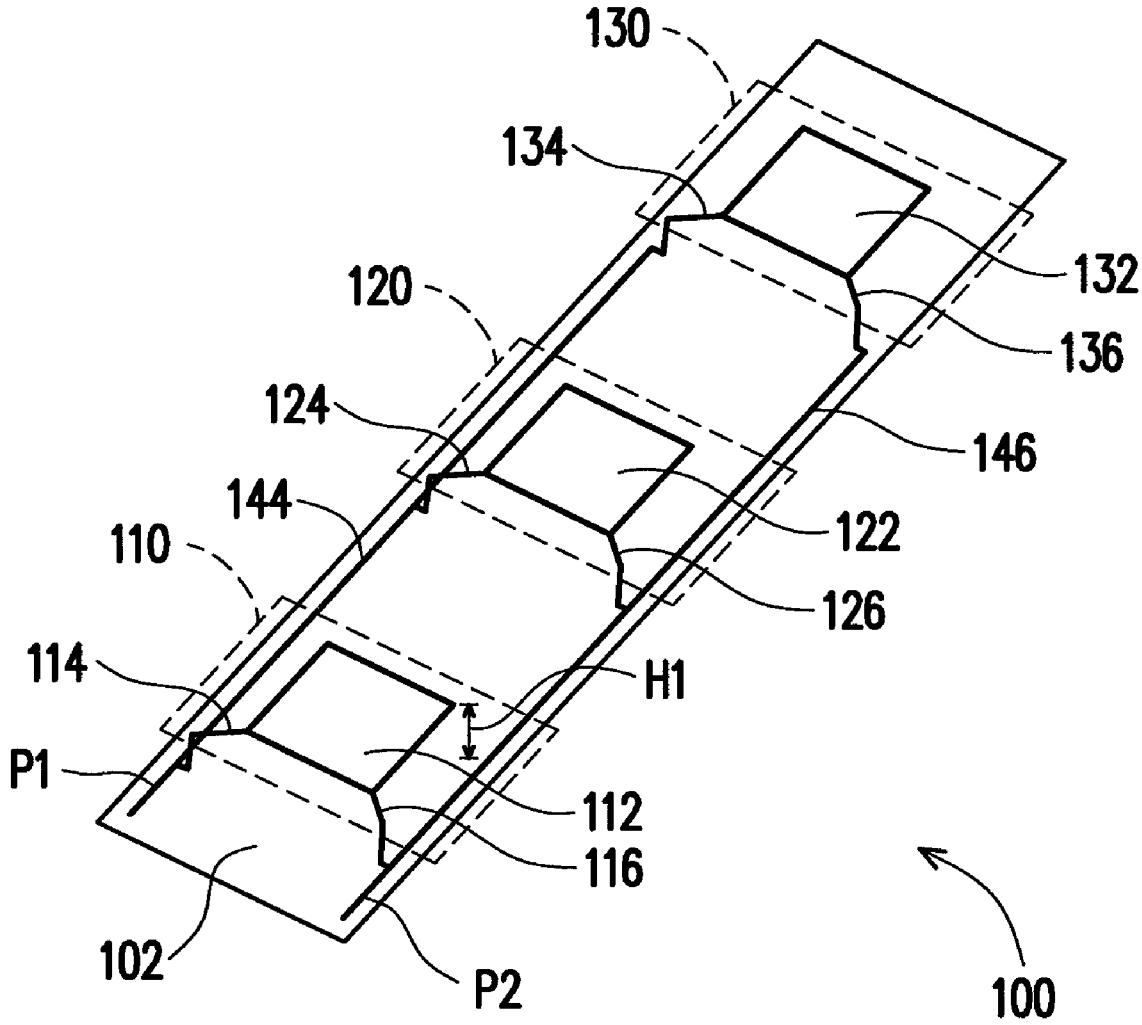
FIG. 1 illustrates an array antenna according to a first embodiment of the present invention.

FIG. 1 illustrates an array antenna according to a first embodiment of the present invention. The array antenna 100 includes a substrate 102, a plurality of antenna units 110~130, and connection lines 144, 146. The antenna unit 110 includes a rectangular radiation region 112 and feeding lines 114, 116. The rectangular radiation region 112 may be rectangular or square in shape, and includes four sides and four feeding corners. One end of each of the feeding lines 114, 116 is connected to a respective one of two adjacent feeding corners of the rectangular radiation region 112. The structure of the antenna unit 120~130 is the same as the structure of the antenna unit 110. In the present embodiment, the antenna units 120~130 are arranged linearly and equidistantly spaced, and the connection lines 144, 146 are disposed at two opposite sides of the rectangular radiation regions 112, 122, 132. The connection line 144 is connected to the other ends of the feeding lines 114, 124, 134. The connection line 146 is connected to the other ends of the feeding lines 116, 126, 136. One end of the connection line 144 and one end of the connection line 146 act as connection ports P1, P2 through which a back-end circuit can transmit and receive signals.

The rectangular radiation regions 112, 122, 132 of the antenna units 110~130 are spaced apart from the substrate 102 by a suspension height H1. If a reflective plate (not shown) used as a ground plane of the antenna units 110~130 is disposed on a first surface of the substrate 102, the suspension height H1 between the substrate 102 and the rectangular radiation regions 112, 122, 132 can provide a distance between the reflective plate and the rectangular radiation regions 112, 122, 132. In addition, the reflective plate may also be disposed on a backside or an intermediate metal layer of the substrate 102. The substrate 102 may, for example, be a printed circuit board (PCB). The connection lines 144 and 146 may be formed by the metal layer on the first surface of the substrate 102, and the reflective plate may be formed by first/second surfaces or an internal metal layer of the substrate 102.

Figure 2A:
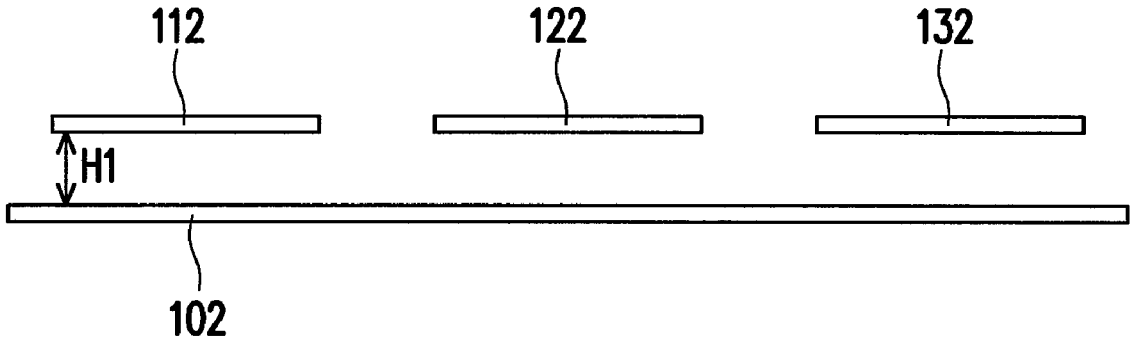
FIG. 2A is a side view of the array antenna according to the first embodiment of the present invention.

FIG. 2A is a side view of the array antenna according to the first embodiment of the present invention. Referring to FIG. 2A, the substrate 102 and the rectangular radiation regions 112, 122, 132 have the suspension height H1 therebetween. The rectangular radiation regions 112, 122, 132 can be supported above the substrate 102 by plastic molds (not shown). In addition, it should be noted that when the reflective plate 102 is disposed on the backside (the second surface), the rectangular radiation regions 112, 122, 132 may be directly formed by the metal layer on the first surface of the substrate 102. In this case, the distance between the rectangular radiation regions 112, 122, 132 and the reflective plate becomes equal to the thickness of the substrate 102. This configuration is especially suitable where the circuit and antenna are integrated into a same PCB.

Figure 2B:
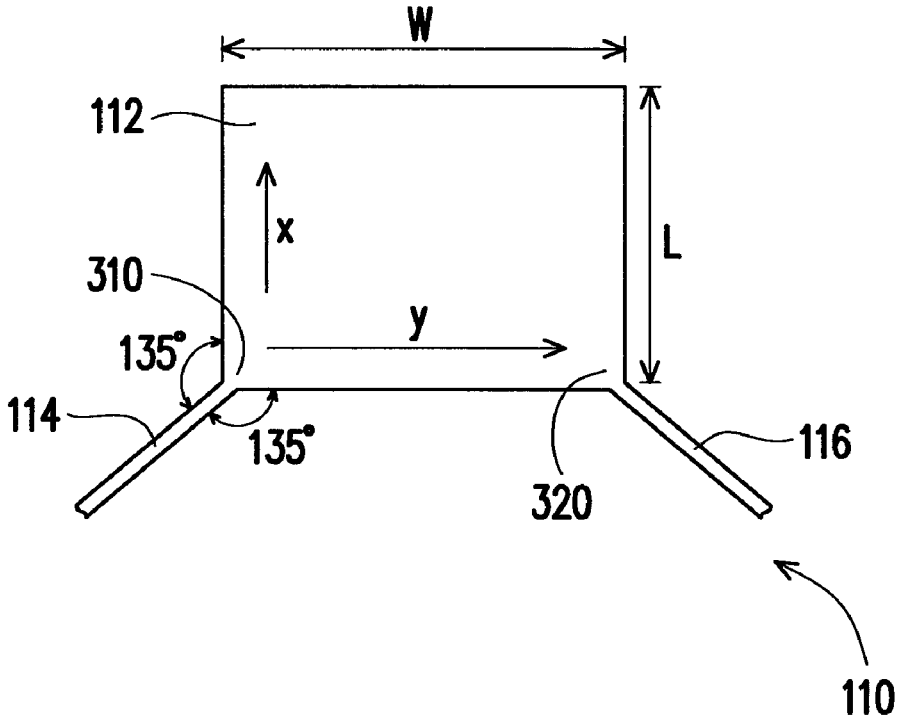
FIG. 2B illustrates the antenna unit according to the first embodiment of the present invention.

In addition, the polarization direction and operation bandwidth of the array antenna 100 are dependent on the shape of the rectangular radiation regions 112, 122, 132. FIG. 2B illustrates the antenna unit 110 according to the first embodiment of the present invention. One end of the feeding line 114 is connected to a feeding corner 310 of the rectangular radiation region 112, and one end of the feeding line 116 is connected to a feeding corner 320 of the rectangular radiation region 112. The feeding line 114 and an adjacent side of rectangular radiation region 112 form therebetween an angle of 135 degrees, and the feeding line 116 and an adjacent side of the rectangular radiation region 112 form therebetween an angle of 135 degrees. The operation $$f = \frac{C}{\lambda} = \frac{C}{\lambda_g\sqrt{\varepsilon_e}} = \frac{C}{(L+h)2\sqrt{\varepsilon_e}}$$

$$\varepsilon_e = \frac{\varepsilon_r+1}{2} + \frac{\varepsilon_r-1}{2}\left(1+\frac{12h}{W}\right)^{-\frac{1}{2}}$$

bandwidth of the antenna unit can be determined by the following equation:

where f represents frequency, C represents the speed of light, λ represents the wavelength of an electromagnetic wave in free space, $\in_\gamma$ represents the dielectric constant of the substrate, W represents the width of the rectangular radiation region, L represents the length of the rectangular radiation region, and h represents the thickness of the substrate. The design of the rectangular radiation regions 112, 122, 132 would be apparent to those skilled in the art upon reading the above description and is therefore not described herein.

When the back-end circuit feeds a signal to the rectangular radiation region 112 through the feeding line 114 or feeding line 116, the antenna unit 110 is linearly polarized. The directions of electrical currents resulted from the signals fed through the feeding line 114 and the feeding line 116 are perpendicular to each other. Therefore, the back-end circuit may selectively switch the feeding line 114 and the feeding line 116 for dual polarization receiving, or use both the feeding line 114 and feeding line 116 to transmit and receive signals.

Besides, the rectangular radiation region 112 of the present embodiment is also able to realize circular polarization. The circular polarization can be realized by maintaining a 90-degree difference between the current in the X direction and the current in the Y direction of the rectangular radiation region 114 when the signal is fed through the feeding line 114, which can be achieved by adjusting the size and side length of the rectangular radiation region 114. On the other hand, because the four feeding corners of the rectangular radiation region 114 are symmetrically positioned, a 90-degree difference between the current in X direction and the current in the Y direction of the rectangular radiation region 114 may also be maintained when the signal is fed through the feeding line 116. In other words, whichever feeding line (feeding line 114 or 116) the back-end circuit chooses to feed the signal, the rectangular radiation region 114 can achieve the circular polarization.

Next, referring to FIG. 1, the connection lines 144, 146 each are connected to the feeding lines of a same side of the antenna units 110~130 to form the array antenna 100. When the back-end circuit is used with the array antenna 100 illustrated in FIG. 1, the back-end circuit can be connected to the antenna units 110, 120, 130 at the connection ports P1, P2, and choose suitable polarization direction to improve signal transmitting/receiving performance through the switch of the connection ports P1, P2.

Figure 3:
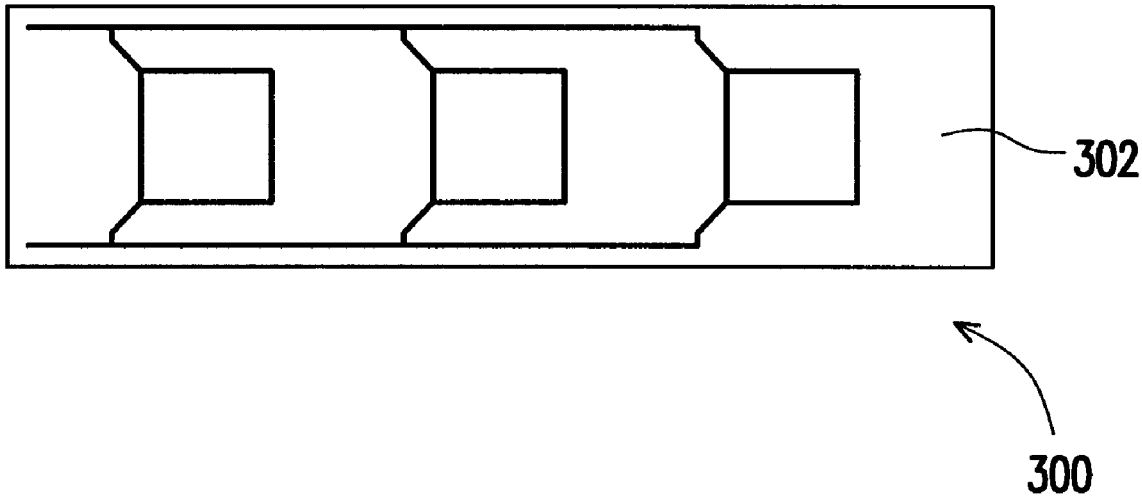
FIG. 3 illustrates an array antenna according to the first embodiment of the present invention.

In addition, the array antenna 100 may be directly formed on the PCB as illustrated in FIG. 3. FIG. 3 illustrates an array antenna according to the first embodiment of the present invention. The array antenna 300 is different from the array antenna 100 in that the rectangular radiation regions, feeding lines and connection lines of the array antenna 300 are directly formed on the first surface of the substrate 302 by etching the metal layer on the first surface of the substrate 302, and the metal layer on the second surface of the substrate 302 is used to form the reflective plate.

Second Embodiment

Figure 4A:
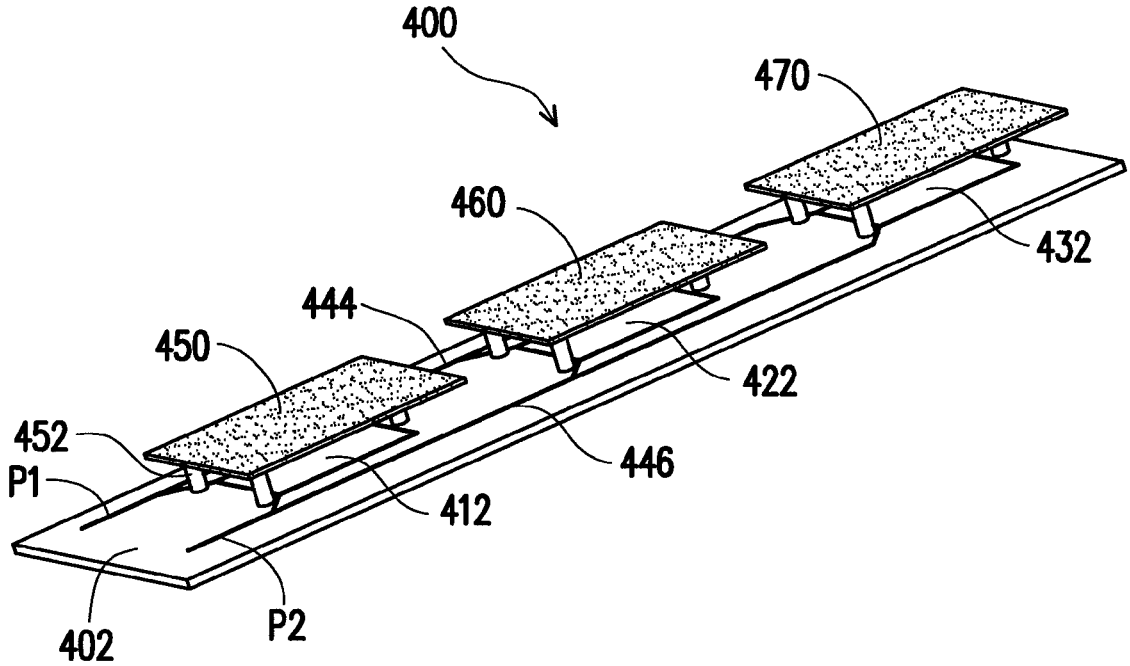
FIG. 4A illustrates an array antenna according to a second embodiment of the present invention.

In order to increase the gain of the array antenna 100 and adjust the radiation pattern of the array antenna 100, in the present embodiment, a coupler may be disposed above each of the antenna units 110~130, as illustrated in FIG. 4A. FIG. 4A illustrates an array antenna according to a second embodiment of the present invention. The main difference between the array antenna 400 of FIG. 4A and the array antenna 300 of FIG. 3 lies in the couplers 450, 460, 470 that are positioned above the rectangular radiation regions 412, 422, 432, respectively. Another difference is that the rectangular radiation regions 412, 422, 432 of the present embodiment are directly formed on the first surface of the substrate 402, and the reflective plate (not shown) is formed on the second surface of the substrate 402 in position correspondence with the rectangular radiation regions 412, 422, 432.

The configuration of the rectangular radiation regions 412, 422, 432 and the connection between the rectangular radiation regions 412, 422, 432 and the connection lines 444, 446 are the same as those described in the first embodiment, which are not described herein. The couplers 450, 460, 470 may likewise be supported above the substrate 402 by plastic molds 452. Adjusting the height of the couplers 450, 460, 470 above the rectangular radiation regions 412, 422, 432 can adjust the radiation pattern as well as the gain of the array antenna 400.

Figure 4B:
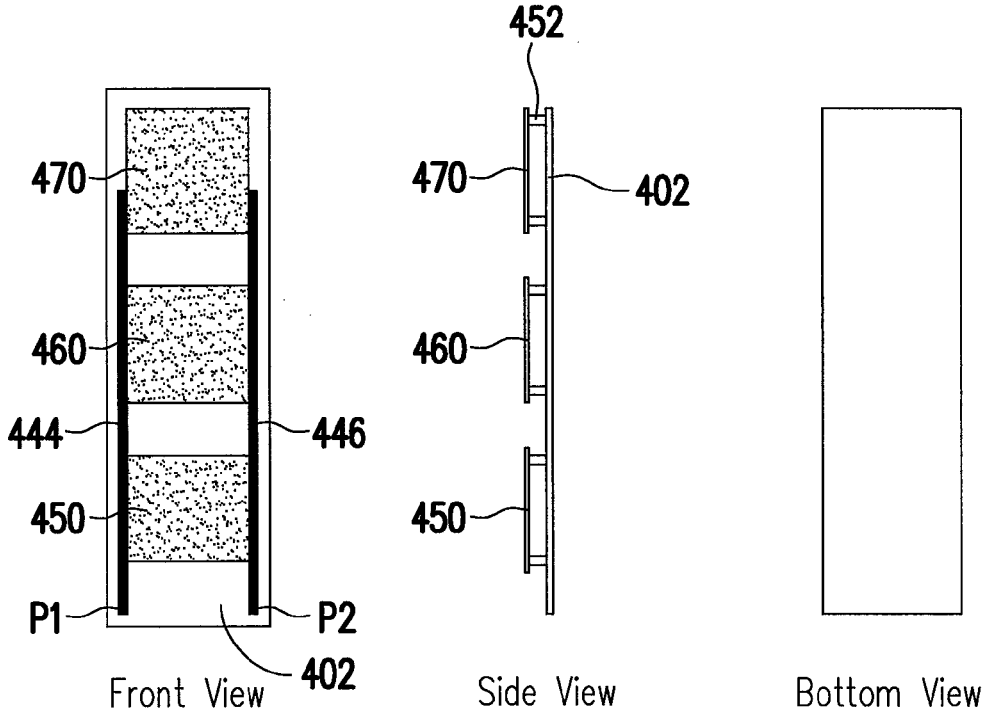
FIG. 4B illustrates the structure of the array antenna of FIG. 4A.

FIG. 4B illustrates the structure of the array antenna 400, specifically illustrating front, side and bottom views of the array antenna 400. The front view of FIG. 4B shows the couplers 450, 460, 470 covering the rectangular radiation regions 412, 422, 432. The side view shows that the couplers 450, 460, 470 and the substrate 402 are spaced apart by a distance. As shown in the bottom view, because the reflective plate is made from a single sheet of metal, the bottom of the substrate 402 is an integral metal plane that serves as the reflective plate for the rectangular radiation regions 412, 422, 432, which can also be referred as a "ground plane". In addition, in the present embodiment, the couplers 450, 460, 470 and the reflective plate can be selectively used or used in combination.

Figure 4C:
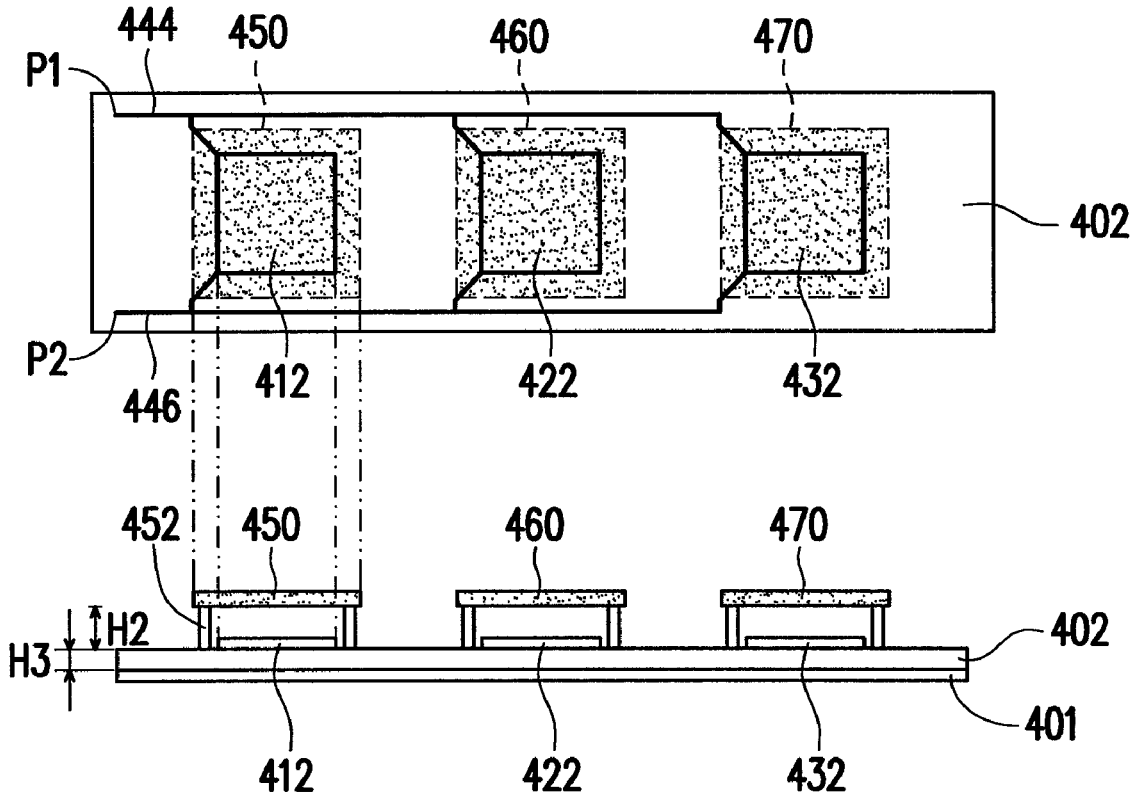
FIG. 4C illustrates a comparison diagram of the front view and side view of the array antenna of the present embodiment of FIG. 4A.

FIG. 4C illustrates a comparison diagram of the front view and side view of the array antenna 400 of the present embodiment. As shown in FIG. 4C, the distance between the couplers 450, 460, 470 and the substrate 402 is H2, and the thickness of the substrate 402 is equal to a distance H3 between the rectangular radiation regions 412, 422, 432 and the reflective plate 401. Plastic molds (e.g., plastic molds 452) are used to support the couplers 450, 460, 470. In addition, it should be noted that while the distance between the rectangular radiation regions 412, 422, 432 and the couplers 450, 460, 470 is set as the distance H2, this distance can be modified according to actual design requirements of electronic apparatus and should not be limited to the embodiments described herein. FIG. 4C illustrates the structure in which the couplers 450, 460, 470, rectangular radiation regions 412, 422, 432, and reflective plate 401 are integrated into the PCB. The back-end circuit may be directly integrated into a same PCB to reduce the size of the electronic apparatus. Other details regarding such integration would be apparent to those skilled in the art upon reading the above description and are thus not described herein.

Third Embodiment

Figure 5A:
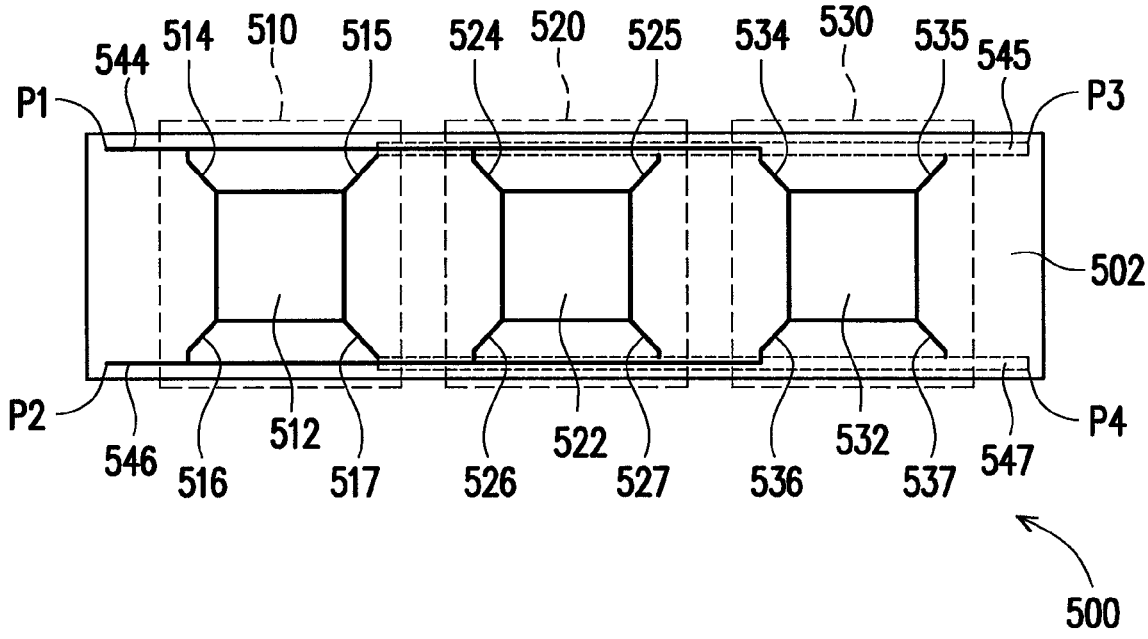
FIG. 5A illustrates an array antenna according to a third embodiment of the present invention.

FIG. 5A illustrates an array antenna according to a third embodiment of the present invention. The array antenna 500 includes antenna units 510, 520, 530. Feeding lines 514, 515, 516, 517 and a rectangular radiation region 512 collectively form the antenna unit 510. Feeding lines 524, 525, 526, 527 and a rectangular radiation region 522 collectively form the antenna unit 520. Feeding lines 534, 535, 536, 537 and a rectangular radiation region 532 collectively form the antenna unit 530. A connection line 544 is connected the other ends of the feeding lines 514, 524, 534. A connection line 546 is connected to the other ends of the feeding lines 516, 526, 536. A connection line 545 is connected to the other ends of the feeding lines 515, 525, 535. A connection line is connected to the other ends of the feeding lines 517, 527, 537. In other words, four feeding corners of each of the rectangular radiation regions 512, 522, 532 is connected to the four connection lines 544, 546, 545, 547, respectively. The connection lines 544, 546, 545, 547 have four connection ports P1, P2, P3, P4, respectively.

The rectangular radiation regions 512, 522, 532 may be directly formed on the first surface of the substrate 502. Taking the antenna unit 510 having the rectangular radiation region 512 as an example, one end of each of the feeding lines 514, 515, 516, 517 is connected to a respective one of the four feeding corners of the rectangular radiation region 512, with each feeding line connected at a 135-degree angle with respect to an adjacent side of the rectangular radiation region 512 and symmetrically arranged with one another. The structure of the other antenna units is similar to the structure of the antenna unit 510 and is therefore not described herein.

In operation, the back-end circuit can feed a signal to the rectangular radiation regions 512, 522, 532 through the connection ports P1, P2, P3, P4. Whichever of the connection ports P1, P2, P3, P4 is used to feed the signal, the rectangular radiation regions 512, 522, 532 can achieve circular polarization or linear polarization (vertical or horizontal polarization). If two of the connection ports (e.g., (P1, P2) or (P3, P4) or (P1, P3) or (P2, P4)) are used in combination, the antenna can be used to receive dual polarization signals. In addition, if the rectangular radiation regions 512, 522, 532 are configured to be circularly polarized, then the array antenna 500 can generate different circular polarizations (left-hand circular polarization or right-hand circular polarization) according to different connection ports P1, P2, P3, P4 that are being used.

Figure 5B:
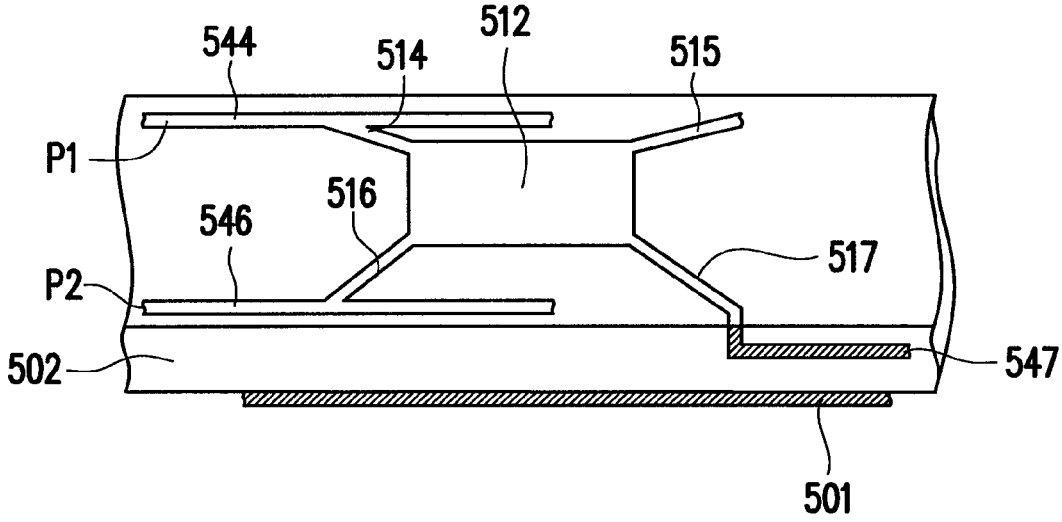
FIG. 5B illustrates the connection lines of the present embodiment.

It should be noted that the connection lines 544, 546, 545, 547 cannot be interconnected and, therefore, the connection lines 544, 546 and the connection lines 545, 547 may be formed by different metal layers. Currently, multilayer PCBs can be made through the PCB fabrication process. Therefore, in the present embodiment, the connection lines 544, 546 may be formed by a first metal layer Metal 1, and the connection lines 545, 547 may be formed by a second metal layer Metal 2. FIG. 5B illustrates the connection lines of the present embodiment. As shown in FIG. 5B, the connection lines 544, 546, rectangular radiation region 512, feeding lines 514, 515, 516, 517 are formed on the first surface (referred to as "first metal layer") of the substrate 502. The connection lines 545, 547 are formed by a second metal layer at an interior of the substrate to avoid short-circuit between the connection lines 545, 547 and the connection lines 544, 546. The reflective plate 501 is formed on the second surface of the substrate 502. The other antenna units are similarly constructed and are therefore not described herein.

Fourth Embodiment

Figure 6A:
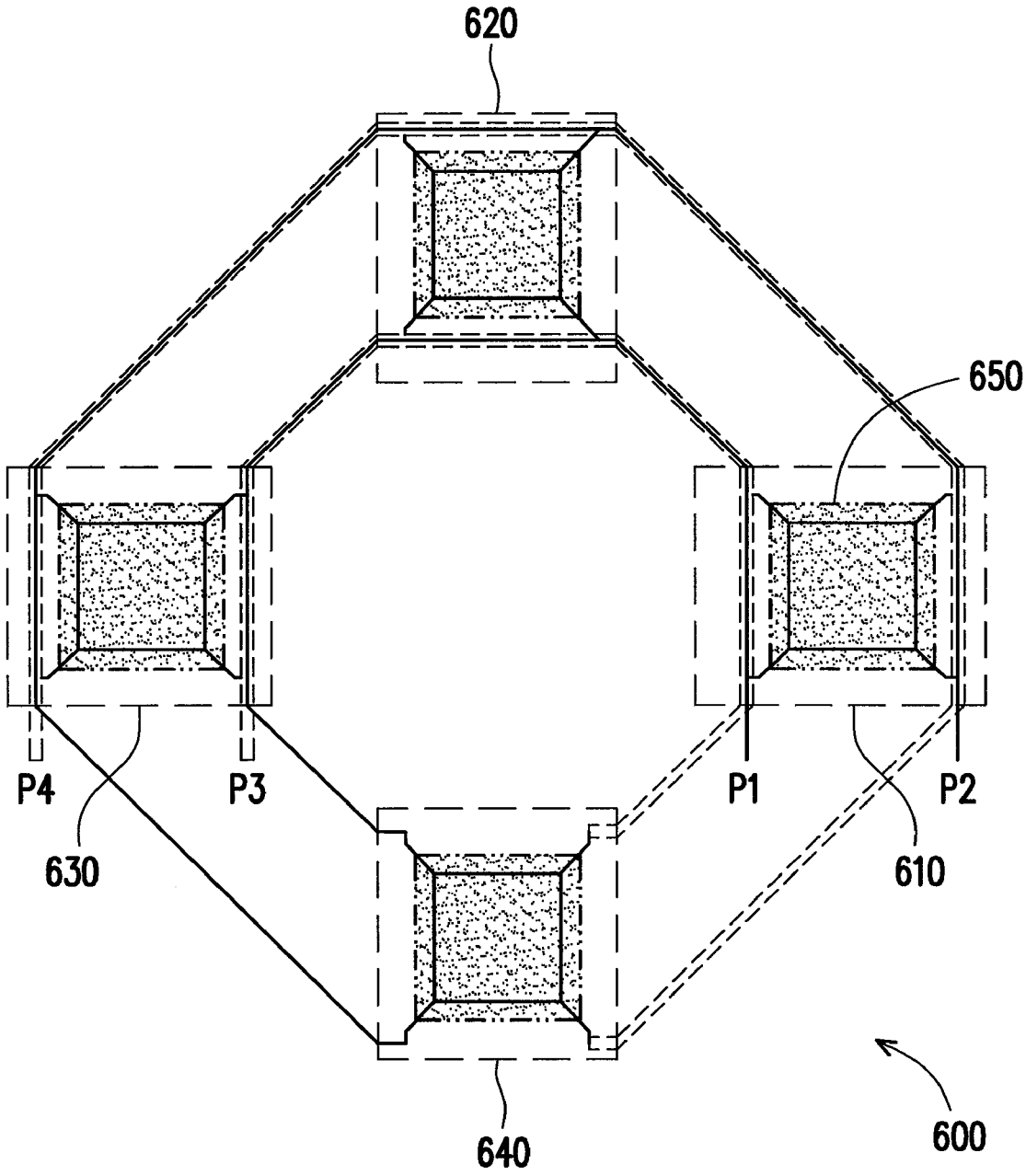
FIG. 6A illustrates an array antenna according to a fourth embodiment of the present invention.

FIG. 6A illustrates an array antenna according to a fourth embodiment of the present invention. Referring to FIG. 6A, the main difference between the array antenna 600 and the array antenna 500 of FIG. 5A lies in the number and arrangement of the array units. The array antenna 600 includes four antenna units 610~640 arranged in a ring. In addition, a coupler (e.g., coupler 650) is disposed above each of the antenna units 610~640 to increase the gain of the antenna. The back-end circuit can likewise select and switch the connection ports P1, P2, P3, P4 such that the array antenna 600 can generate different polarizations. The combination of the connection ports P1, P2, P3, P4 can be selected in the same way as described in the third embodiment, which is not described herein.

Figure 6B:
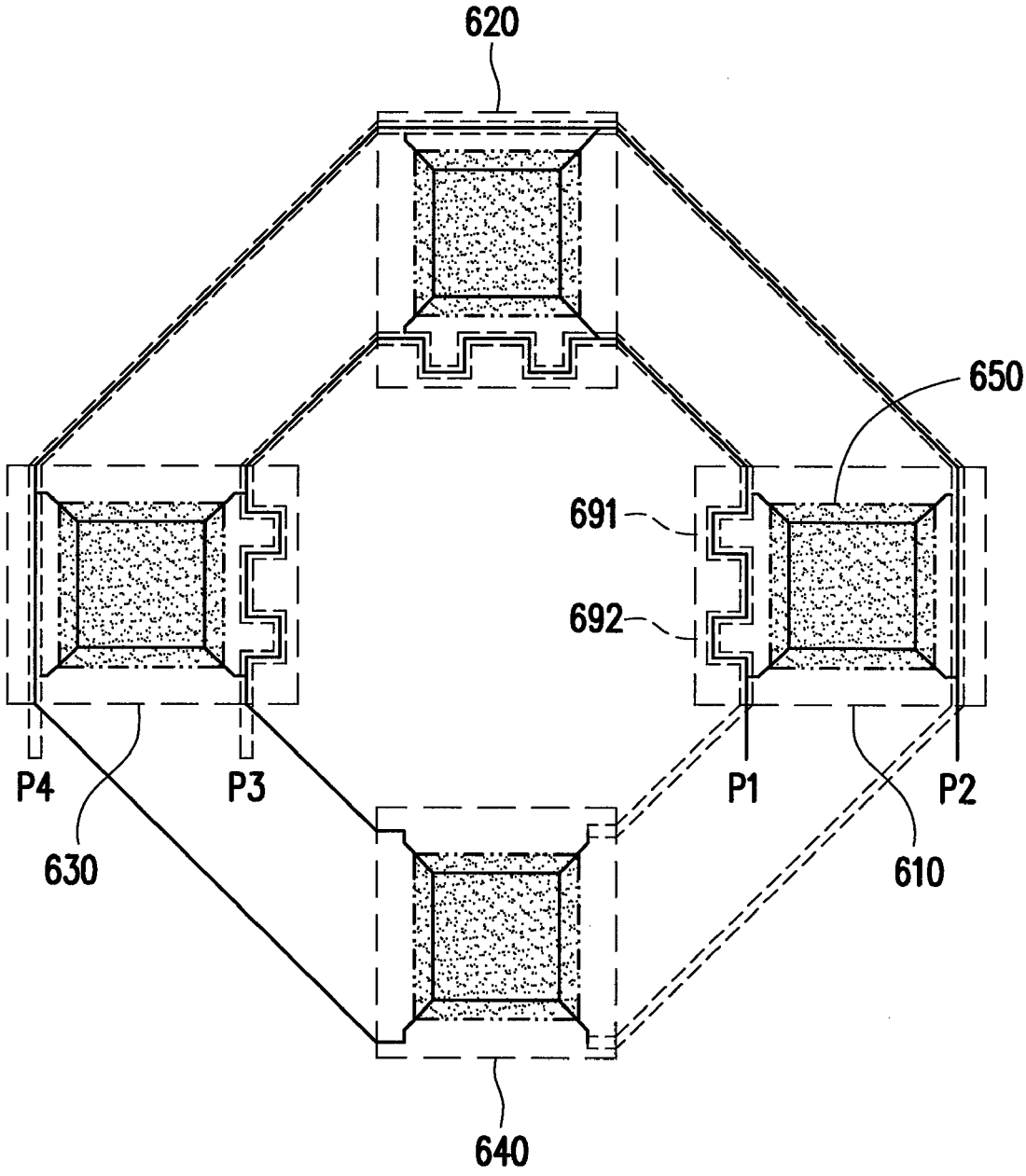
FIG. 6B illustrates the array antenna of the fourth embodiment.

FIG. 6B illustrates the array antenna of the fourth embodiment. The main difference between FIG. 6B and FIG. 6A lies in the arrangement of the connection lines. Because the inner ring has a shorter path, the connection lines (corresponding to the connection ports P1, P3) at the inner ring include a plurality of bends (e.g., 691, 692) such that the connection line corresponding to the connection port P1 and the connection line corresponding to the connection port P2 become equal in length, and the connection line corresponding to the connection port P3 and the connection corresponding to the connection port P4 become equal in length, thereby maintaining a same phase of the signals.

Fifth Embodiment

Figure 7:
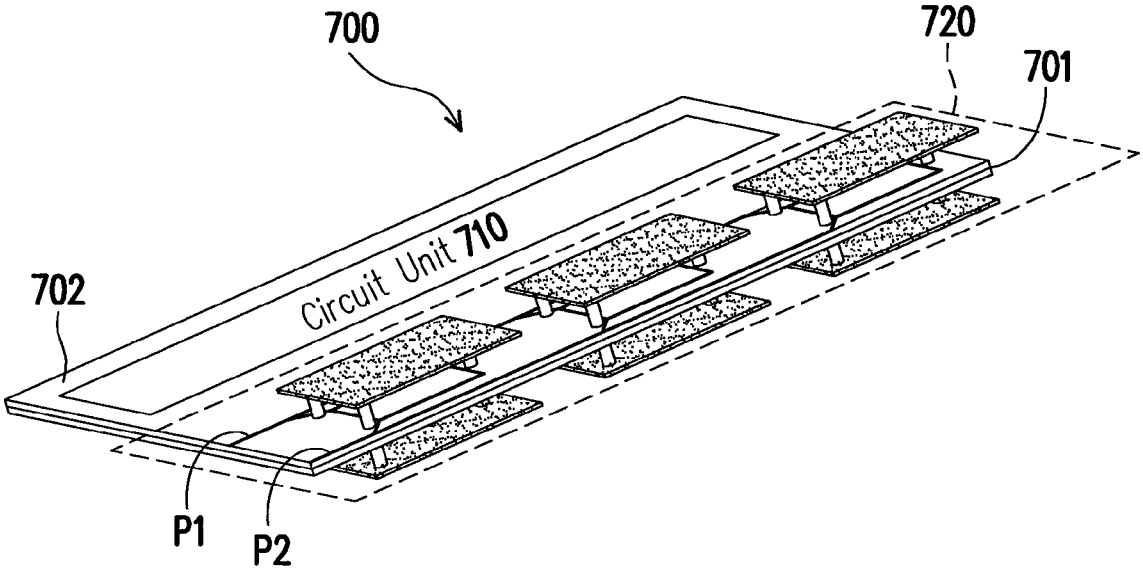
FIG. 7 illustrates an electronic apparatus according to a fifth embodiment of the present invention.

When the array antenna of the above embodiments and the circuit are integrated into the PCB, the number of the antenna units can be increased and the room needed for the array antenna can be reduced by disposing the antenna units on double surfaces of the PCB. FIG. 7 illustrates an electronic apparatus according to a fifth embodiment of the present invention. As shown in FIG. 7, the electronic apparatus 700 includes a circuit unit 710 and an array antenna 720. The circuit unit 710 is connected to the array antenna 720 through the connection ports P1, P2. The main difference between the array antenna 720 and the array antenna 400 of FIG. 4A lies in that the reflective plate 701 is formed by an internal metal layer of the substrate 702, and first and second surfaces of the substrate 702 are both provided with antenna units (including rectangular radiation regions and feeding lines). There are a total of six antenna units, and a coupler is provided above each of the antenna units. The antenna units formed on the first and second surfaces share the common reflective plate 701.

The array antenna 720 can be regarded as being formed by two array antennas 400. The circuit unit 710 can be connected to the antenna units above the substrate 702 through the connection ports P1, P2, and connected to the antenna units below the substrate 702 through the connecting ports below the substrate 702. The antenna units above and below the substrate may also share the common connection ports P1, P2 to simplify feeding points of the signals. With respect to the directivity of the antenna, because the first and second surfaces of the substrate 702 are both provided with antenna units, the array antenna 720 can achieve good signal receiving and transmitting performance in the directions faced to the first or second surfaces.

In addition, the circuit unit 710 may also switch to different connection ports such that the array antenna 720 receives and transmits signals with different polarizations (linear polarization, dual polarization, and circular polarization), thereby achieving multiple-polarization and omni-directional signal receiving and transmitting. Furthermore, the array antenna 720 includes multiple connection ports. Therefore, there are no limits as to the location of the circuit unit 710 such that whichever side the antenna unit 710 is located at, the circuit unit 710 can be connected to the array antenna 720. It should be noted that, the integration of the circuit unit and the array antenna should not be limited to the array antenna 720 of the present embodiment, but rather, the antenna units of the above first to fourth embodiments and the circuit unit 710 can be integrated into a same PCB.

Figure 8A:
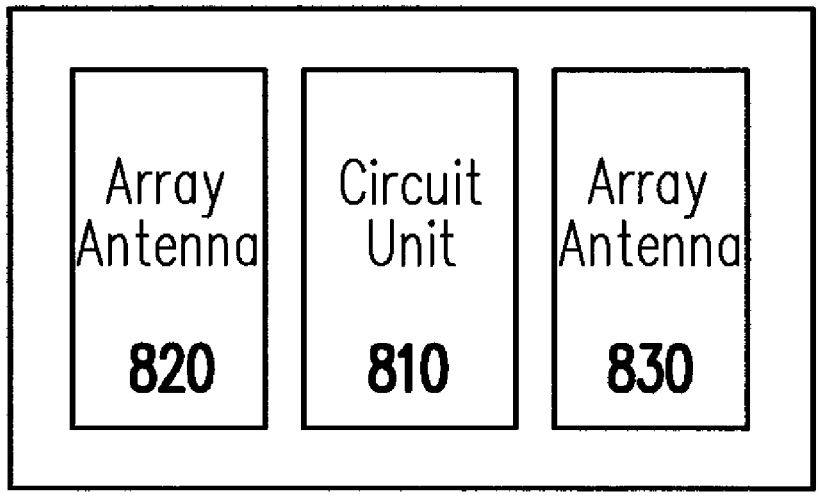
FIG. 8A illustrates a configuration of the electronic apparatus of the present embodiment.
Figure 8B:
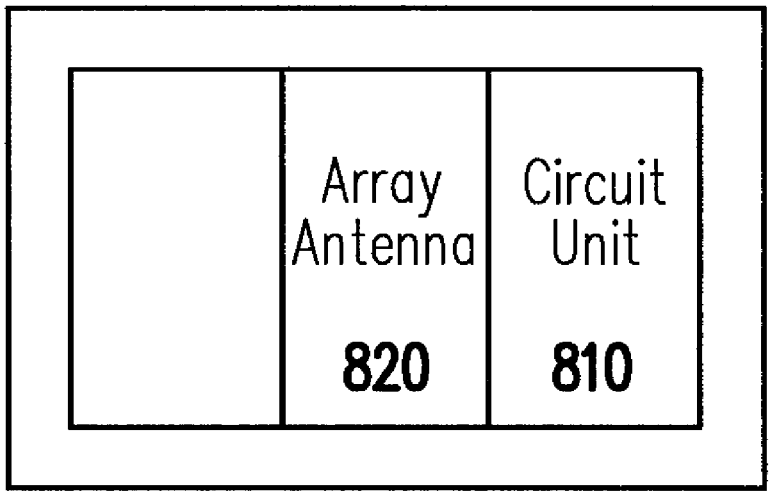
FIG. 8B illustrates a configuration of another electronic apparatus of the present embodiment.

Besides, the positional relationship between the array antenna and the circuit unit is discussed below with reference to FIG. 8A and FIG. 8B. FIG. 8A illustrates a configuration of an electronic apparatus of the present embodiment. The electronic apparatus includes a circuit unit 810, and antenna units 820, 830 are disposed on two sides of the circuit unit 810. The antenna units 820, 830 and the circuit unit 810 can be disposed on a same surface of the substrate. Alternatively, the antenna units 820, 830 can be disposed on a different surface of the substrate. In addition, because the rectangular radiation regions of the present invention can be suspended above the substrate, the circuit unit can be disposed below the array antenna. FIG. 8B illustrates a configuration of another electronic apparatus of the present embodiment. The arrangement of the array antenna and the circuit unit would be apparent to those skilled in the art upon reading the disclosure of the present invention and is not described herein.

Figure 9A:
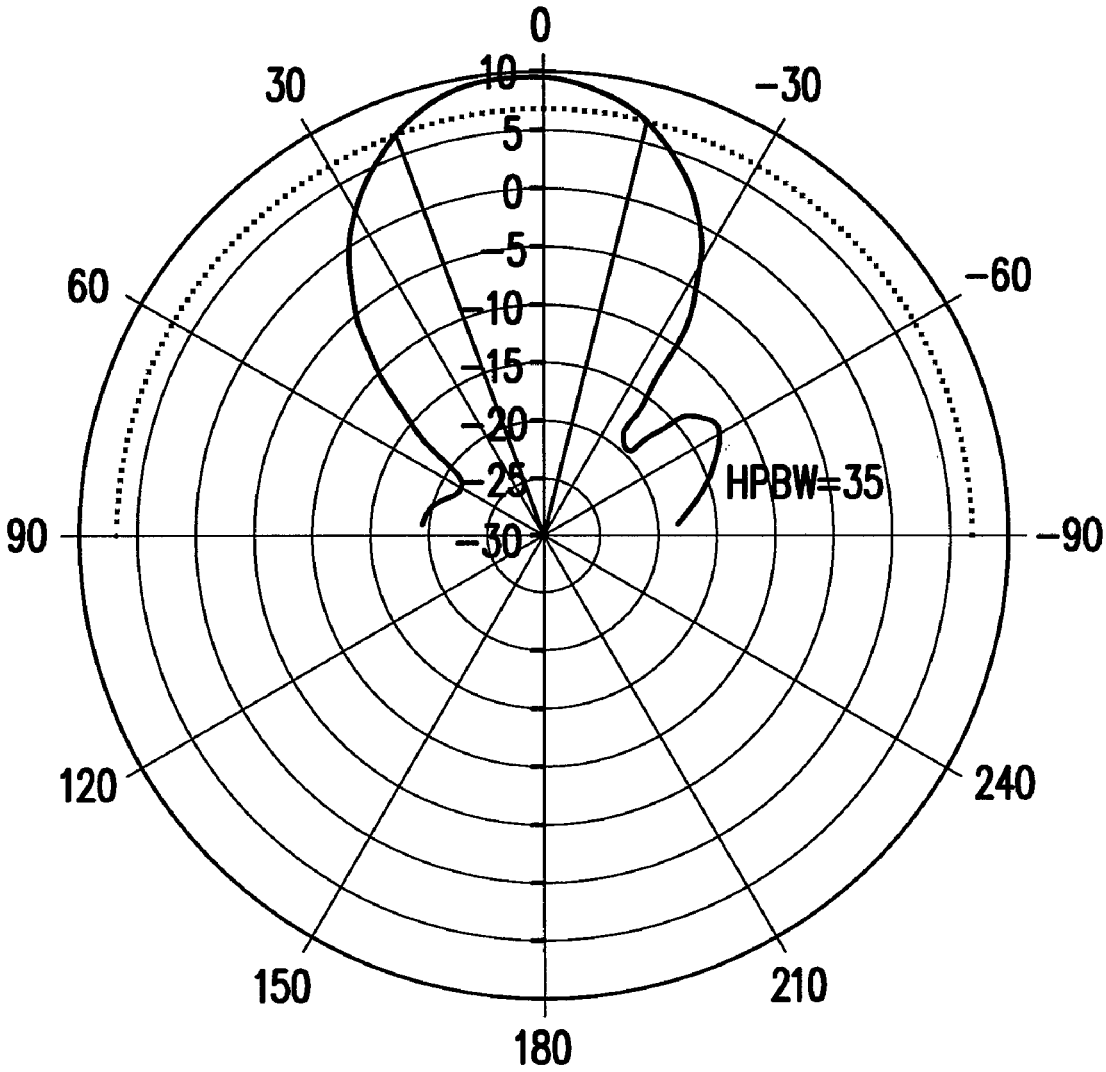
FIG. 9A illustrates an E-plane radiation pattern according to one embodiment of the present invention.
Figure 9B:
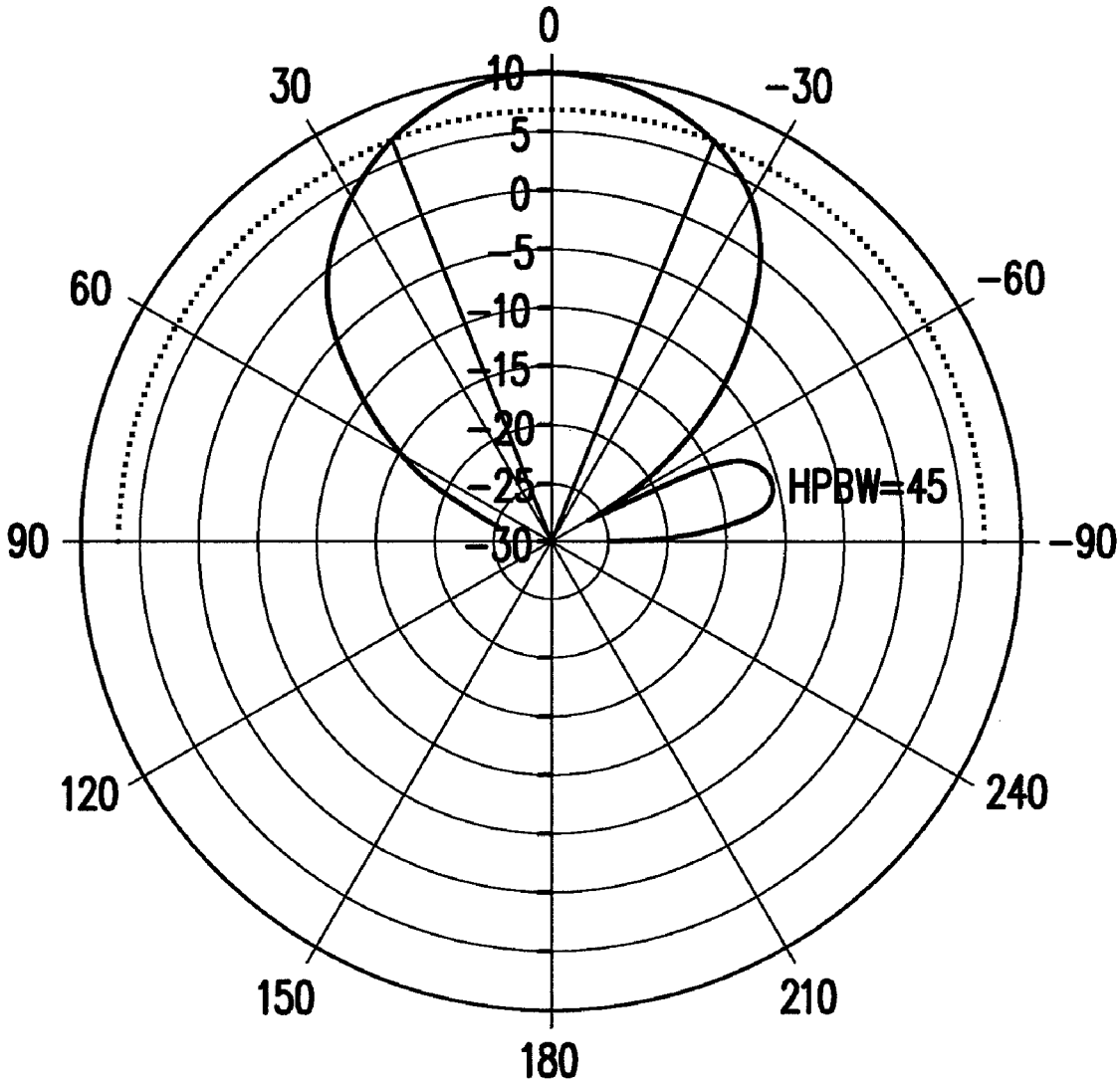
FIG. 9B illustrates an H-plane radiation pattern according to one embodiment of the present invention.

Antenna patterns of the antenna of the present embodiment are discussed with reference to FIG. 9A and FIG. 9B. FIG. 9A illustrates an E-plane radiation pattern according to one embodiment of the present invention. FIG. 9B illustrates an H-plane radiation pattern according to one embodiment of the present invention. As shown in FIG. 9A, the E-plane half power beam width (HPBW) is 35 degrees. As shown in FIG. 9B, the H-plane HPBW is 45 degrees. In comparison with conventional directional antennas, the HPBW of the array antenna of the present invention is significantly increased.

Figure 10:
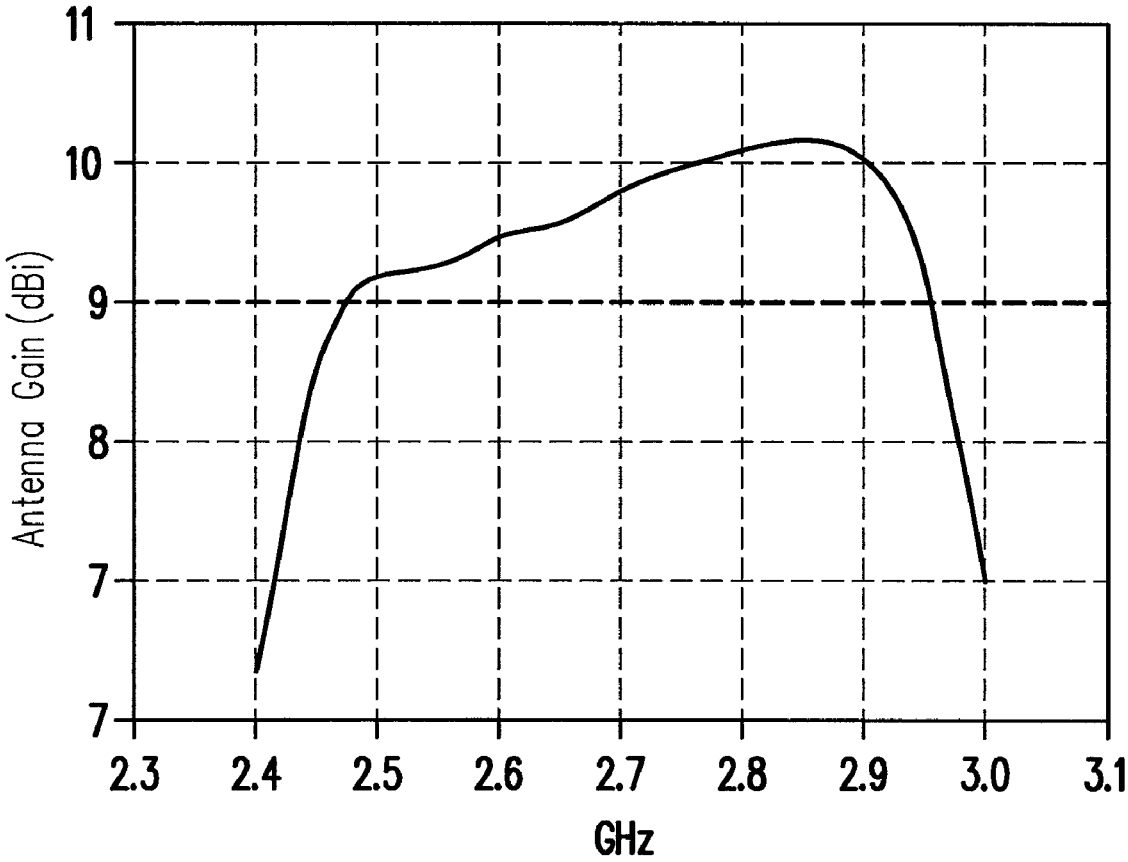
FIG. 10 illustrates an antenna gain diagram according to one embodiment of the present invention.

FIG. 10 illustrates an antenna gain diagram according to one embodiment of the present invention. As shown in FIG. 10, the antenna of the present invention has a gain that is higher than 6 dBi over the bandwidth between 2.4 GHz and 3.0 GHz, and has a gain that is higher than 9 dBi over the bandwidth between 2.5 GHz and 2.95 GHz. As far as wireless communication is concerned, the present invention can significantly enhance the signal receiving and transmitting capability of the array antenna.

In summary, in embodiments of the present invention, the complexity of the configuration of the array antenna is reduced by adopting symmetrical feeding. The antenna unit with dual polarization and circular polarization can be achieved by using the polarization characteristics of the rectangular radiation region. The array antenna of the present invention not only has a small size and can be easily integrated with an electronic apparatus, but also has the advantages of multiple polarizations, multiple directionality and high gain.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An array antenna comprising:

a substrate;

a plurality of antenna units arranged in series, each of the antenna units including a rectangular radiation region, a first feeding line and a second feeding line, one end of each of the first and second feeding lines being connected to a respective one of adjacent first and second feeding corners of the rectangular radiation region;

a first connection line disposed on the substrate and arranged at a first side of the rectangular radiation regions for connection with the other ends of the first feeding lines of the antenna units;

a second connection line disposed on the substrate and arranged at a second side of the rectangular radiation regions for connection with the other ends of the second feeding lines of the antenna units; and at least one reflective plate disposed on the substrate and spaced apart from each of the rectangular radiation regions by a distance.

2. The array antenna according to claim 1, wherein an angle between the first feeding line and the first side of the rectangular radiation region is 135 degrees, and an angle between the second feeding line and the second side of the rectangular radiation region is 135 degrees.

3. The array antenna according to claim 1, wherein the series-arranged antenna units are arranged linearly.

4. The array antenna according to claim 1, wherein the antenna units are equidistantly spaced.

5. The array antenna according to claim 1, wherein the rectangular radiation region is spaced apart from the substrate by a suspension height.

6. The array antenna according to claim 1, wherein the rectangular radiation region is disposed on a first surface of the substrate, and the reflective plate is disposed on a second surface of the substrate.

7. The array antenna according to claim 1, further comprising a plurality of couplers disposed above the antenna units, respectively.

8. The array antenna according to claim 1, wherein each of the antenna units further includes a third feeding line and a fourth feeding line, and one end of each of the third and fourth feeding lines is connected to a respective one of adjacent third and fourth feeding corners of the rectangular radiation region.

9. The array antenna according to claim 8, further comprising:

a third connection line, wherein the third connection line and the first connection line are located in different layers of the substrate, and the third connection line is connected to the other ends of the third feeding lines of the antenna units; and a fourth connection line, wherein the fourth connection line and the second connection line are located in different layers of the substrate, and the fourth connection line is connected to the other ends of the fourth feeding lines of the antenna units.

10. The array antenna according to claim 1, wherein the antenna units are arranged in a ring.

11. The array antenna according to claim 10, wherein the first connection line and the second connection line are equal in length.

12. An electronic apparatus comprising:

a substrate;

a plurality of first antenna units arranged in series on a first surface of the substrate, each of the first antenna units including a first rectangular radiation region, a first feeding line and a second feeding line, one end of each of the first and second feeding lines being connected to a respective one of adjacent first and second feeding corners of the first rectangular radiation region;

a first connection line disposed on the substrate and arranged at a first side of the rectangular radiation regions for connection with the other ends of the first feeding lines of the first antenna units;

a second connection line disposed on the substrate and arranged at a second side of the rectangular radiation regions for connection with the other ends of the second feeding lines of the first antenna units;

at least one reflective plate disposed on the substrate and spaced apart from each of the rectangular radiation regions by a distance; and a circuit unit disposed on the first surface of the substrate and connected to the first antenna units through the first connection line and the second connection line.

13. The electronic apparatus according to claim 12, further comprising a plurality of second antenna units disposed on a second surface of the substrate, wherein each of the second antenna units includes a second rectangular radiation region, a third feeding line and a fourth feeding line, and one end of each of the third and fourth connection lines is connected to a respective one of adjacent third and fourth feeding corners of the second radiation region.

14. The electronic apparatus according to claim 13, wherein the first connection line is connected to the other ends of the third feeding lines of the second antenna units, and the second connection line is connected to the other ends of the fourth feeding lines of the second antenna units.

15. The electronic apparatus according to claim 13, further comprising:

a third connection line configured to be connected to the other ends of the third feeding lines of the second antenna units; and a fourth connection line configured to be connected to the other ends of the fourth feeding lines of the second antenna units;

wherein the third connection line and the fourth connection line are located on the second surface of the substrate, and the circuit unit is connected to the second antenna units through the third connection line and the fourth connection line.

16. The electronic apparatus according to claim 13, further comprising a plurality of couplers disposed above the first antenna units and second antenna units, respectively.

17. The electronic apparatus according to claim 12, wherein an angle between the first feeding line and a first side of the first rectangular radiation region is 135 degrees, and an angle between the second feeding line and a second side of the first rectangular radiation region is 135 degrees.

18. The electronic apparatus according to claim 12, wherein each of the first antenna units further includes:

a third feeding line and a fourth feeding line, one end of each of the third and fourth feeding lines being connected to a respective one of adjacent third and fourth feeding corners of the first rectangular radiation region;

a third connection line configured to be connected to the other ends of the third connection lines of the first antenna units; and a fourth connection line configured to be connected to the other ends of the fourth connection lines of the first antenna units.

19. The electronic apparatus according to claim 12, wherein the first antenna units are arranged linearly or in a ring.

20. The electronic apparatus according to claim 12, wherein the first connection line and the second connection are equal in length.

* * * * *